US008535181B2

(12) United States Patent
Staten et al.

(10) Patent No.: US 8,535,181 B2
(45) **Date of Patent: *Sep. 17, 2013**

(54) FOOTBALL SLED WITH BLOCKER PAD RANGE OF MOTION

(75) Inventors: Kenneth E. Staten, Clare, MI (US); Grant Rogers, Sanford, MI (US); Jacob Rogers, Sanford, MI (US); Kyle R. Camp, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 159 days.

This patent is subject to a terminal disclaimer.

(21) Appl. No.: 12/971,183

(22) Filed: Dec. 17, 2010

(65) Prior Publication Data

US 2011/0152014 A1 Jun. 23, 2011

Related U.S. Application Data

(60) Provisional application No. 61/287,761, filed on Dec. 18, 2009.

(51) Int. Cl.
*A63B 69/34* (2006.01)

(52) U.S. Cl.
USPC ..... 473/445

(58) Field of Classification Search
USPC ..... 473/465, 445, 444, 441, 415; 73/865.4; 463/4; 414/2; 273/350; 248/316.5; 206/523, 206/320, 192, 174
See application file for complete search history.

(56) References Cited

U.S. PATENT DOCUMENTS

| | | | | |
|---|---|---|---|---|
| 3,103,039 | A * | 9/1963 | Robinson | 425/549 |
| 4,140,315 | A * | 2/1979 | Page, Jr. | 473/445 |
| 5,385,523 | A * | 1/1995 | Forrest | 473/445 |
| 6,942,585 | B1 * | 9/2005 | Krause | 473/445 |
| 7,497,792 | B2 * | 3/2009 | Hutton | 473/422 |
| 2008/0058128 | A1 * | 3/2008 | Joseph | 473/441 |
| 2011/0152013 | A1 * | 6/2011 | Staten et al. | 473/445 |
| 2011/0152014 | A1 * | 6/2011 | Staten et al. | 473/445 |
| 2012/0157244 | A1 * | 6/2012 | Staten et al. | 473/445 |

* cited by examiner

*Primary Examiner* — Gene Kim
*Assistant Examiner* — M Chambers
(74) *Attorney, Agent, or Firm* — Carlson, Gaskey & Olds P.C.

(57) ABSTRACT

A range of motion assembly for a blocking sled includes a pivot assembly to provide a range of motion and a cartridge system to restrict the range of motion.

20 Claims, 8 Drawing Sheets

FOOTBALL SLED WITH BLOCKER PAD RANGE OF MOTION

The present disclosure claims priority to U.S. Provisional Patent Application No. 61/287,761, filed Dec. 18, 2010.

BACKGROUND

The present disclosure relates to sports equipment, and more particularly to a football sled with a range of motion to simulate a blocker.

Football has continued to evolve into a faster more lateral movement game as the athletes get bigger, stronger, and more importantly, faster. Various types of football training equipment is used to allow players to practice their techniques without facing off against another live player.

A common example of such equipment is a football training sled for teaching fundamental and functional techniques such as tackling and blocking. A typical football sled includes a horizontal base, including one or more sled-like runners and a padded vertical extension mounted at one end of the sled base. The padded portion of the sled may be sized and shaped to represent an opposing player. A lineman may practice blocking techniques by blocking against the padded portion of the sled, driving the sled straight backwards as he would an opposing player.

SUMMARY

To train and develop more complex schemes and coordinated blocking assignments in Zone Blocking we have developed a blocker sled that provides a safe simulation thereof. As zone blocking requirements have teammates handling double teams, releasing to take on the next dangerous defender, the blocker sled disclosed herein can simulate the weight, resistance and natural movement of a defender.

Also, as football offense is now more complex, the defense must train to physically play the offender, as well as break through the blocker to take the seam, hence putting the defender in a position to attack or disrupt the ball carrier. The blocker sled disclosed herein moves like a blocker to allow the defender to work on shocking the offensive player, creating leverage and violently separating or attacking the offender.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
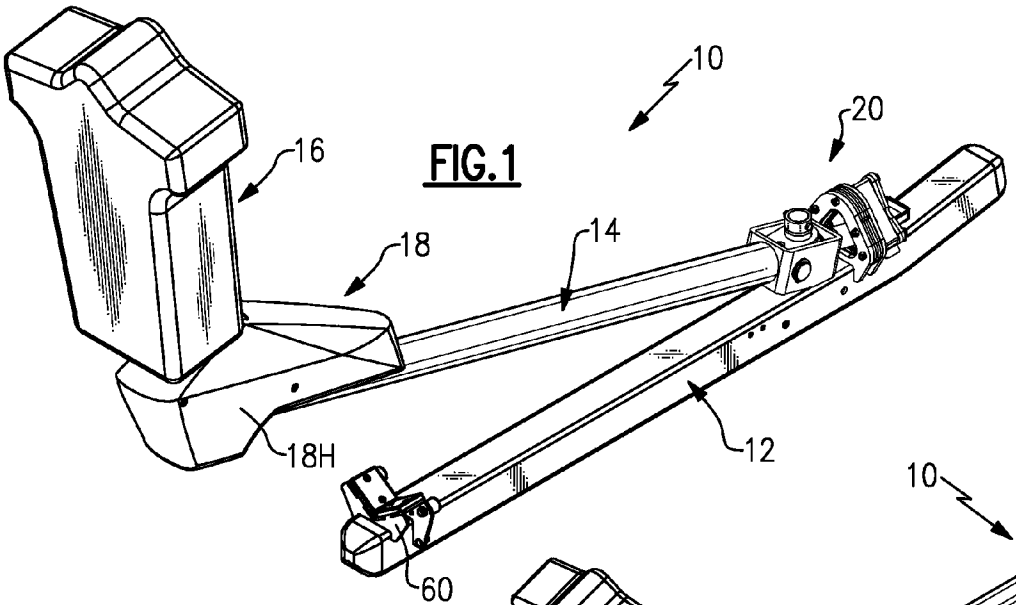
FIG. 1 is a perspective view of a football blocking sled.
Figure 2:
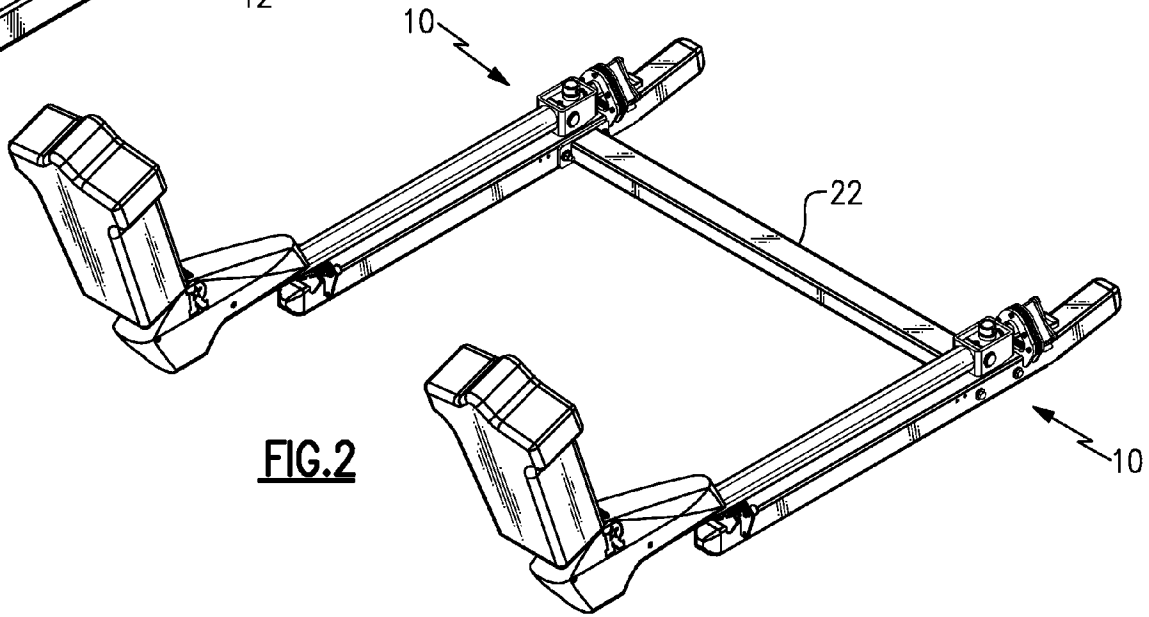
FIG. 2 is a perspective view of a multiple of football blocking sleds linked together.

FIG. 1 illustrates a football blocking sled 10 referred herein as the Tek Sled. The sled 10 generally includes a sled frame 12, an arm 14, a blocking pad 16, a damper arrangement 18 and a range of motion assembly 20. Although two sleds 10 are typically arranged together such as in the disclosed, non limiting embodiment, it should be understood that any number of sleds 10 may be connected together through a respective cross bar 22 to essentially represent a line of football players. That is, any number of sled frames 12 may be interconnected through respective cross bars 22 (FIG. 2) through bolting or other fastening arrangements.

Figure 3:
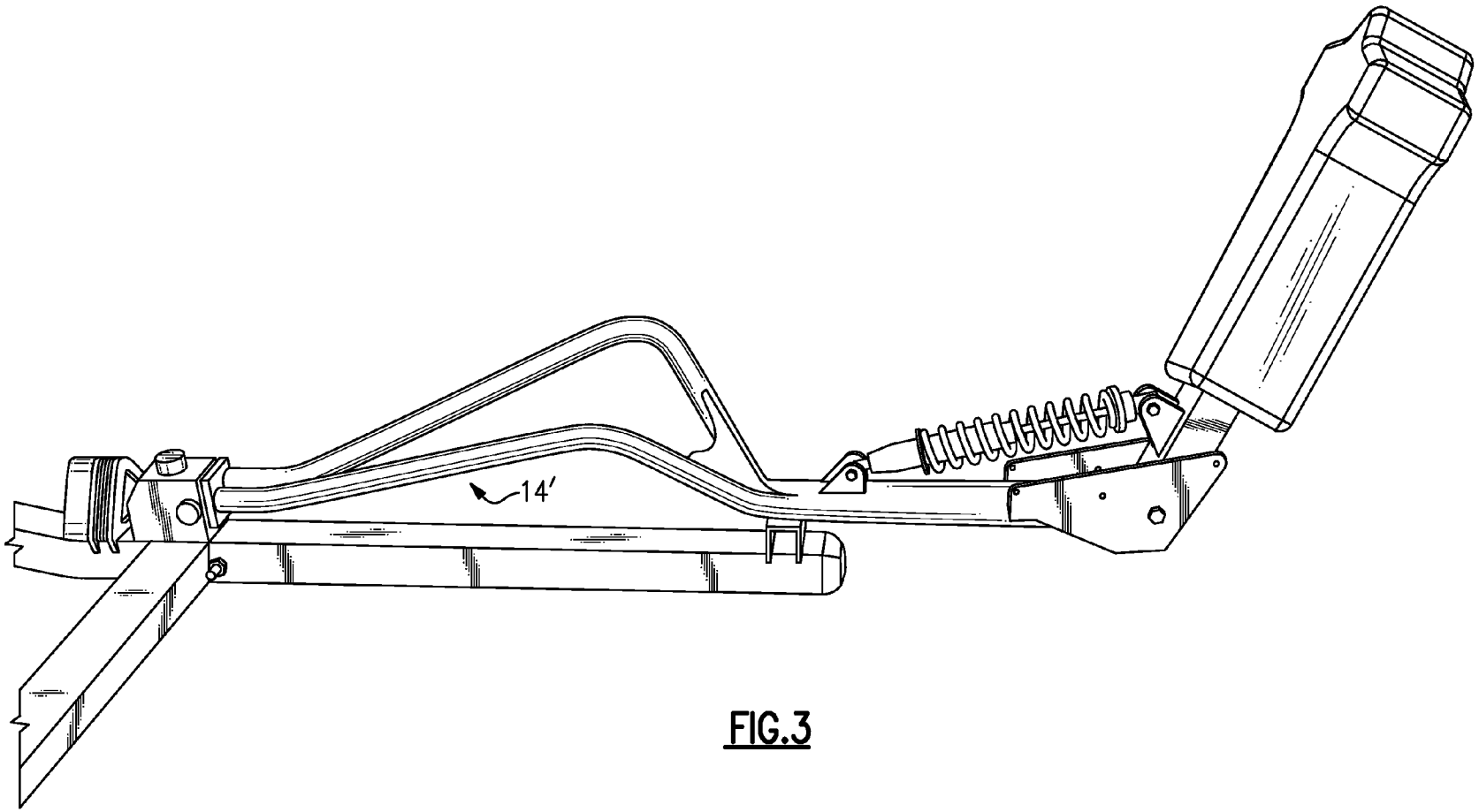
FIG. 3 is a perspective view of another non-limiting embodiment of an arm for a football blocking sled.

In one non-limiting embodiment, the arm 14 is a single tubular component, however, the arm 14 may alternatively be of various forms such as a split tube design 14' (FIG. 3). Such arrangements may facilitate movement of a player in a desired direction after engagement with the blocking pad 16.

Figure 4:
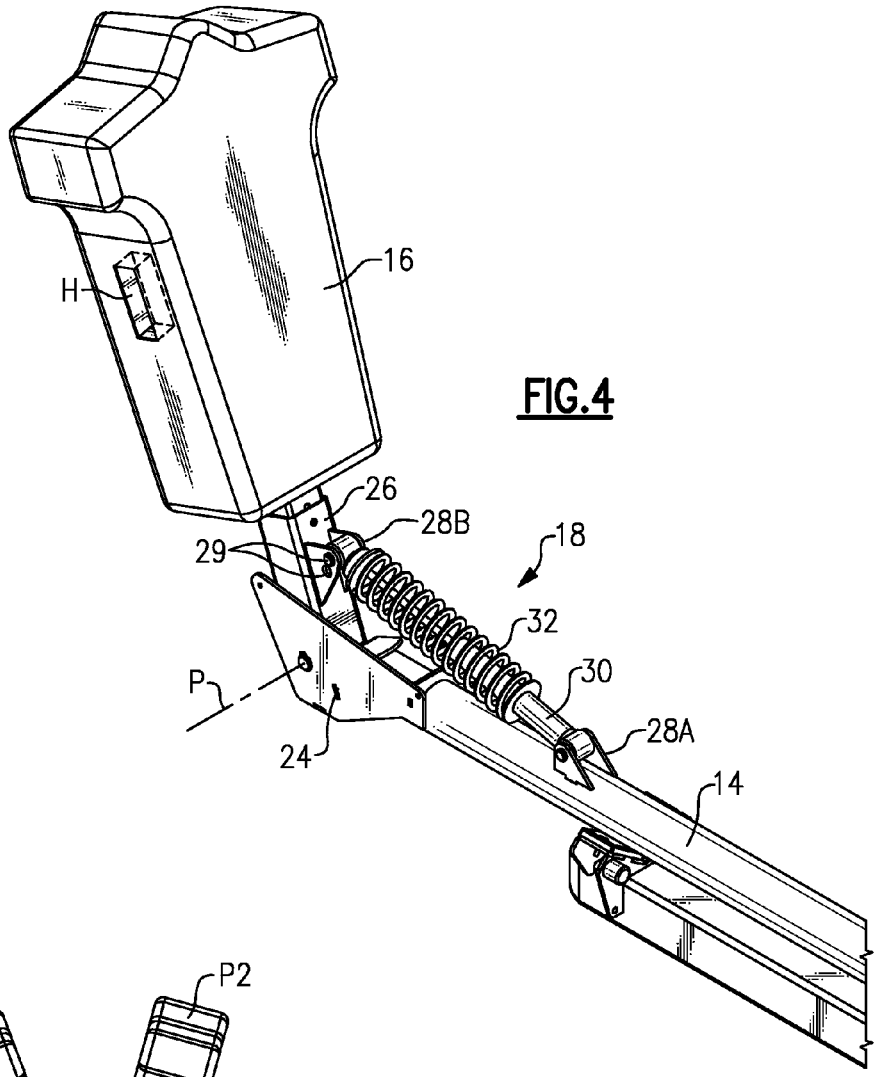
FIG. 4 is a perspective view of a damper assembly for the football blocking sled.

With reference to FIG. 4, the blocking pad 16 is attached to the arm 14 through the damper arrangement 18 which permits force application to the blocking pad 16 to also be absorbed by the damper arrangement 18. The blocking pad 16 is attached to the arm 14 at a pivot assembly 24 which defines an axis P between the arm 14 and a blocking pad socket 26 within the pivot assembly 24. That is, the blocking pad socket 26 and the blocking pad 16 removably mounted thereto pivots relative to the arm 14 about pivot axis P. It should be understood that various blocking pads 16 such as a blocking pad with handholds H may be adapted for receipt into the socket 26. For further understanding of other blocking pads, attention is directed to U.S. Pat. No. 7,056,238, entitled Hand-Held Offensive Lineman Training Pad which is assigned to the assignee of the instant disclosure and which is hereby incorporated herein in its entirety.

The damper arrangement 18 generally includes a mount 28A on the arm 14 and a mount 28B on the blocking pad socket 26. The mounts 28A, 28B locate the damper arrangement 18 to define a resistance to a force applied to the blocking pad 16 as the blocking pad 16 pivots through an arc defined by pad axis P. The damper arrangement 18 generally includes a shock 30 such as a hydraulic or pneumatic shock and a spring 32 which may be protected within a housing 18H (FIG. 1). Mount 28B may include a multiple of apertures 29 to calibrate an expected force, e.g., force applied by a high school player as compared to the force applied by a professional football player.

Figure 5:
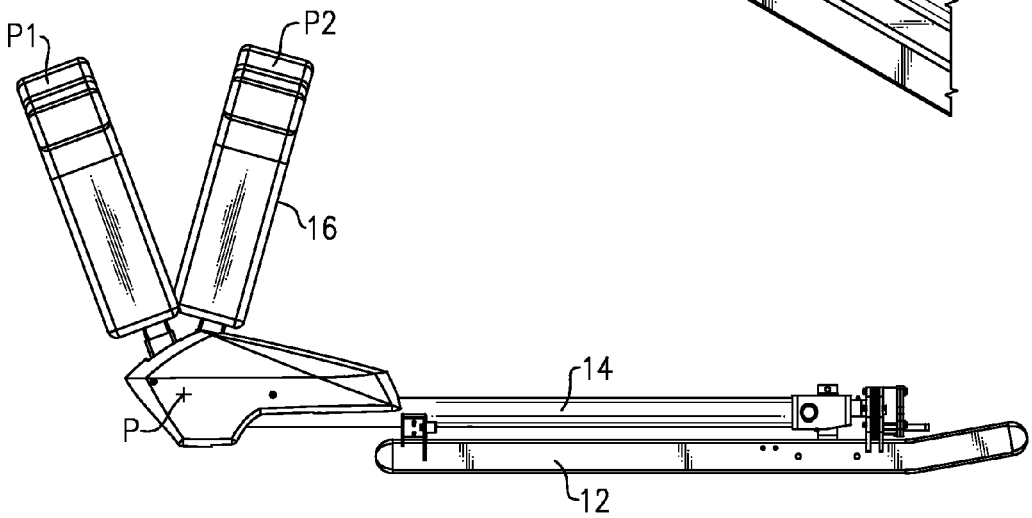
FIG. 5 is a schematic view of the range of motion of a blocker pad relative to an arm of the football blocking sled.

The arc of the blocking pad 16 in one disclosed non-limiting embodiment may be approximately 40 degrees (FIG. 5) in line with the arm 14. That is, the blocking pad 16 may pivot about the pad axis A between a forwardly canted position P1 and a rearwardly canted position P2. The damper arrangement 18 returns the blocking pad 16 to the forwardly canted position P1. It should be understood that various ranges of motion may alternatively or additionally be provided.

Figure 6B:
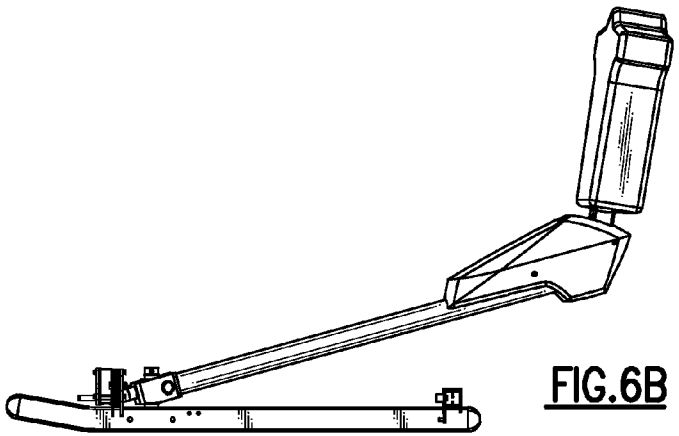
FIGS. 6A-6C are views of the range of motion of an arm of the football blocking sled which supports the blocking pad.
Figure 6C:
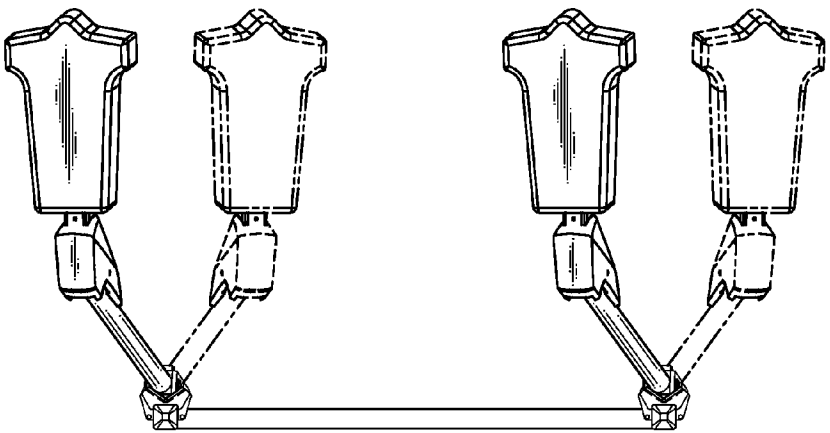
Figure 6A:
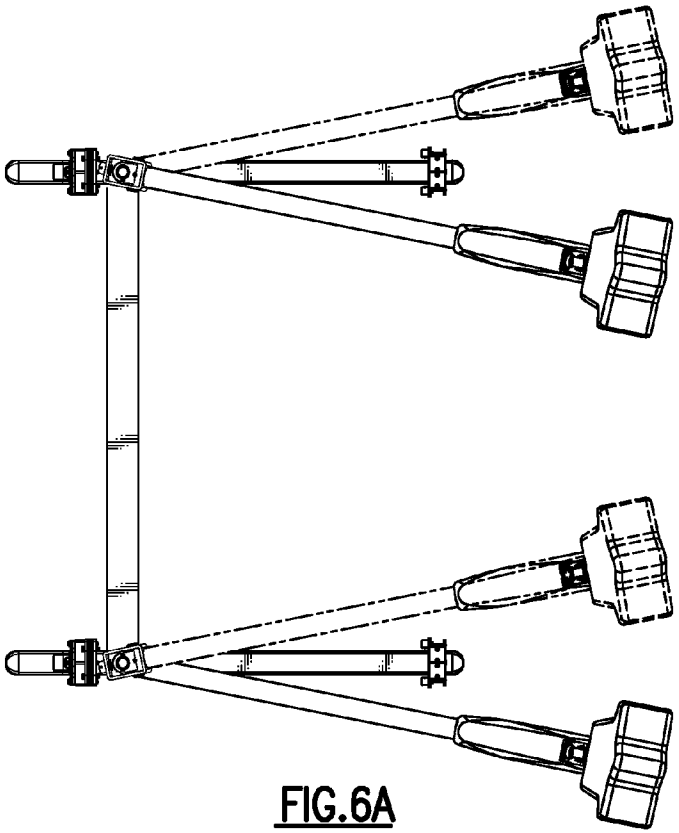

In addition to the motion of the blocking pad 16, the arm 14 supports the blocking pad 16 such that the entire arm 14 and blocking pad 16 may be moved through a range of motion relative to the sled frame 12 as controlled by the range of motion assembly 20. In one disclosed non-limiting embodiment, the range of motion assembly 20 provides a combination of lateral and vertical movement (FIGS. 6A-6C).

Figure 7:
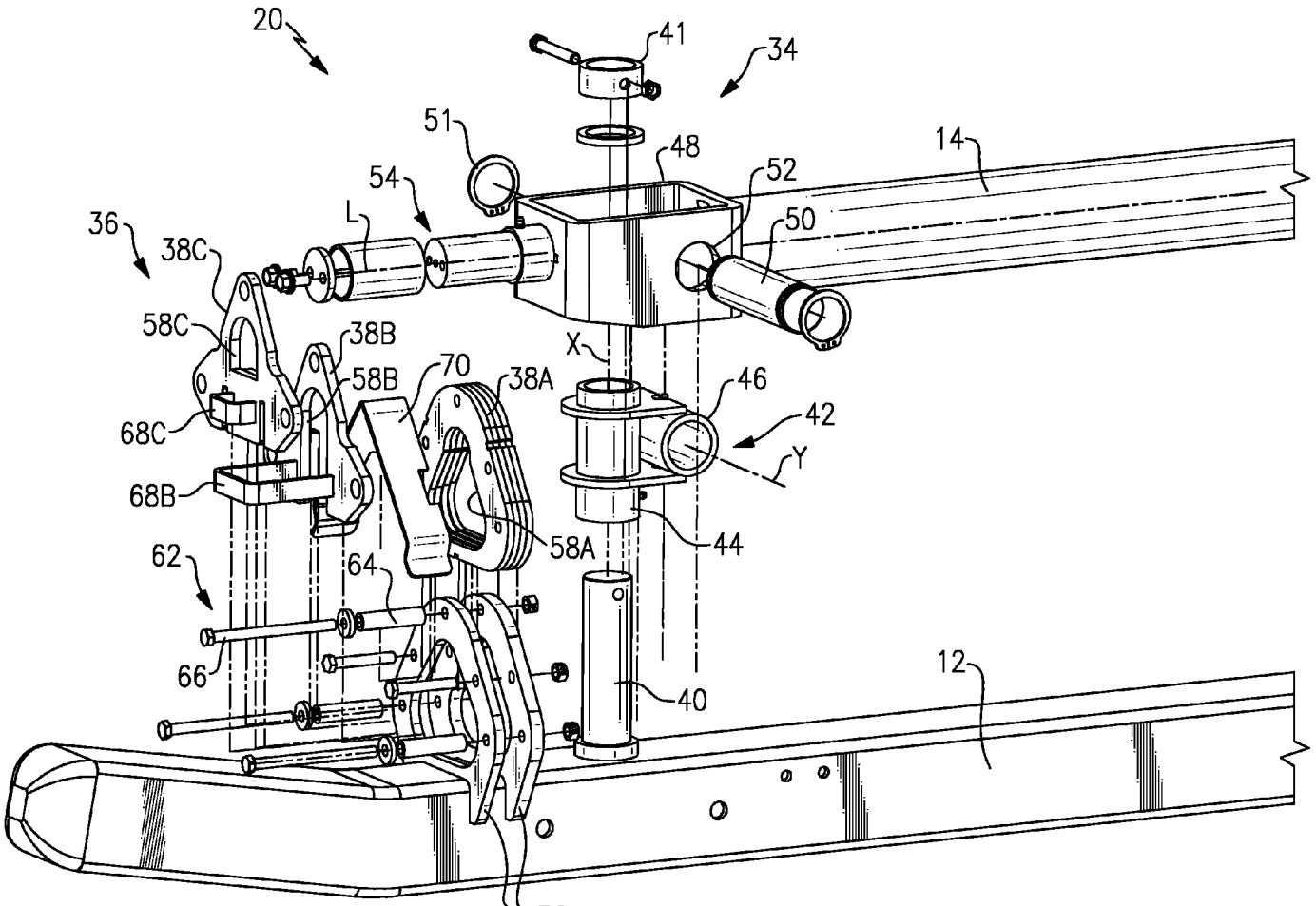
FIG. 7 is an exploded view of a range of motion assembly of the football blocking sled.

With reference to FIG. 7, the range of motion assembly 20 generally includes a pivot assembly 34 and a cartridge system 36. The pivot assembly 34 provides the lateral and vertical movement which may be selectively limited by the cartridge system 36 having a multiple of cartridge plates 38A, 38B and 38C. In one disclosed non-limiting embodiment, the cartridge plates 38A are axially fixed plates which define the full range of lateral and vertical movement relative to the sled frame 12; cartridge plate 38B permits, for example, only vertical movement relative to the sled frame 12; and cartridge plate 38C, for example, locks the arm 14 in a fixed position relative to the sled frame 12.

In one disclosed non-limiting embodiment, the pivot assembly 34 generally includes an axle 40 which extends from the sled frame 12 to receive a pivot joint 42. The pivot joint 42 includes a fist cylinder 44 fixed to a second cylinder 46 in a transverse orientation. The first cylinder 44 defines a vertical axis X to permit lateral movement (FIG. 6A) of the arm 14 about axle 40 and the second cylinder 46 defines a horizontal axis X to permit vertical movement (FIG. 6B) of the arm 14. The first cylinder 44 is received upon axle 40 and may be retained thereon by a fastener assembly 41.

A pivot housing 48 attached to the end of the arm 14 receives the pivot joint 42 to support the arm 14 through a second axle 50. The second axle 50 is received through opposed apertures 52 in the pivot housing 48 and the second cylinder 46 of the pivot joint 42. The second axle 50 is retained therein by retaining rings 51.

A cam 54 extends from the housing 48 generally along an axis L defined by the arm 14. The cam 54 may be a cylindrical member which engages the cartridge system 36. The multiple of cartridge plates 38A, 38B and 38C operate as a cam surface to receive cam 54 and thereby constrain movement of the arm 14.

The cartridge system 36 is mounted to the sled frame 12 adjacent to the pivot assembly 34 for interaction therewith. Mount plates 56 are fixed to the sled frame 12 through welding or the like to receive cartridge plate 38A therebetween. That is, the mount plates 56 provide a fixed structure to support the cartridge system 36 directly adjacent the pivot assembly 34. The mount plates 56 are generally annular triangular shaped members which provide a significant range of motion greater than any cartridge plate 38A, 38B, 38C.

Figure 8A:
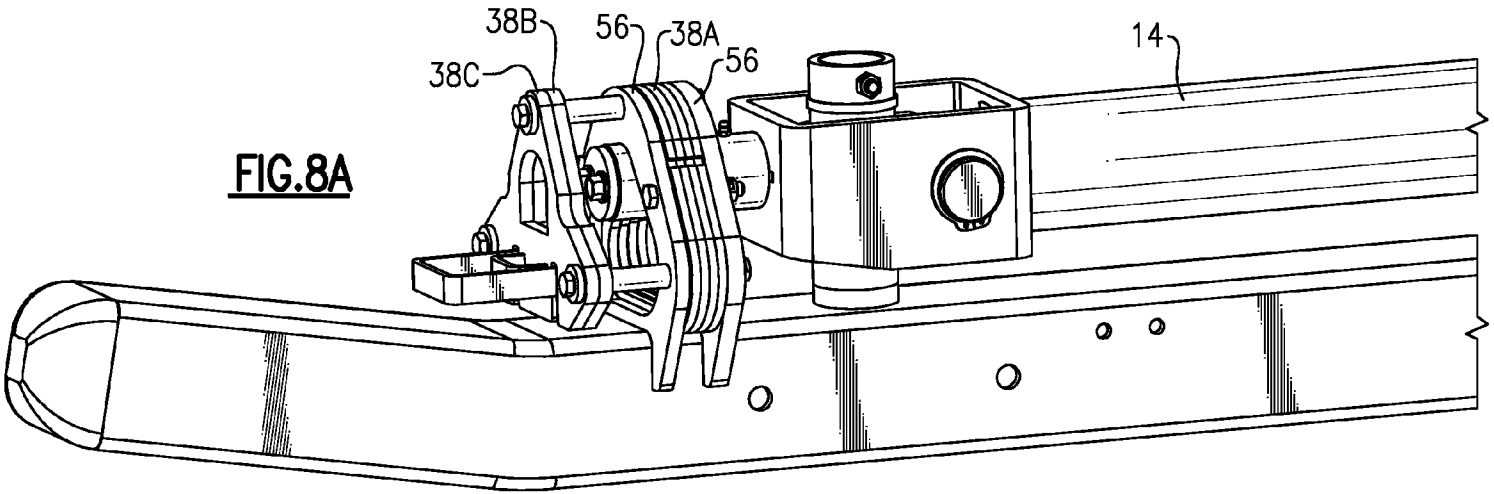
FIG. 8A is a perspective view of a cartridge system of the range of motion assembly of the football blocking sled, the cartridge system having a first cartridge plate which provides a full range of motion.

The cartridge plate 38A is selectively mounted between the mount plates 56 to define the primary range of motion through an aperture 58A. The aperture 58A is generally triangular in shape in the disclosed non-limiting embodiment (FIG. 8A). The shape of the aperture 58A guides the arm 14 so that upon release, for example, from a laterally displaced and lifted position, the arm 14 is guided back to a support 60 mounted to the sled frame 12 (FIG. 1). That is, the generally triangular shape of the aperture 58A defines the full range of lateral and vertical movement (FIGS. 6A-6C) relative to the sled frame 12 and inherently returns the arm 14 to rest position onto support 60. Various other aperture shapes may alternatively be provided to define a desired range of motion for arm 14. That is, the shape of the aperture 58A controls the overall envelope of motion of arm 14 relative to sled frame 12. As illustrated in one disclosed non-limiting embodiment, the cartridge plate 38A may be a multiple of identical plates between mount plates 56 to assure a robust cam surface for the cam 54, however, a relatively thicker single cartridge plate may alternatively or additionally be provided.

The cartridge plates 38B, 38C are axially slidably mounted on standoffs 62 which extend from the mount plates 56 (also illustrated in FIG. 8A). The standoffs 62 may be arranged in a triangular pattern and include sleeves 64 supported upon bolts 66. The cartridge plates 38B, 38C may include handles 68B, 68C to facilitate sliding movement thereof.

Figure 8B:
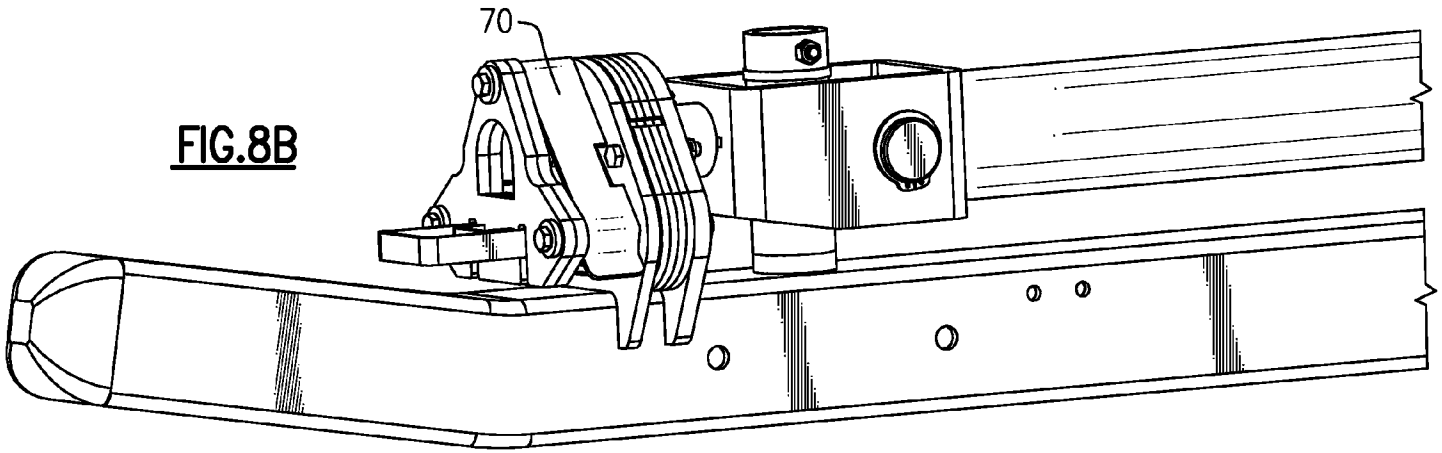
FIG. 8B is a perspective view of a cartridge system in the FIG. 8A position with a lock plate installed.

A removable lock 70 may be snapped onto the standoffs 62 between one of the mount plates 56 and the cartridge plate 38B, 38C to axially retain the cartridge plate 38B, 38C and assure that the generally triangular aperture 58A is the only aperture engaged with the cam 54 (FIG. 8B) to permit the full range of motion. It should be understood that the pivot assembly 34 typically provides a greater range of motion restricted only by the cartridge plate 38A.

Figure 9A:
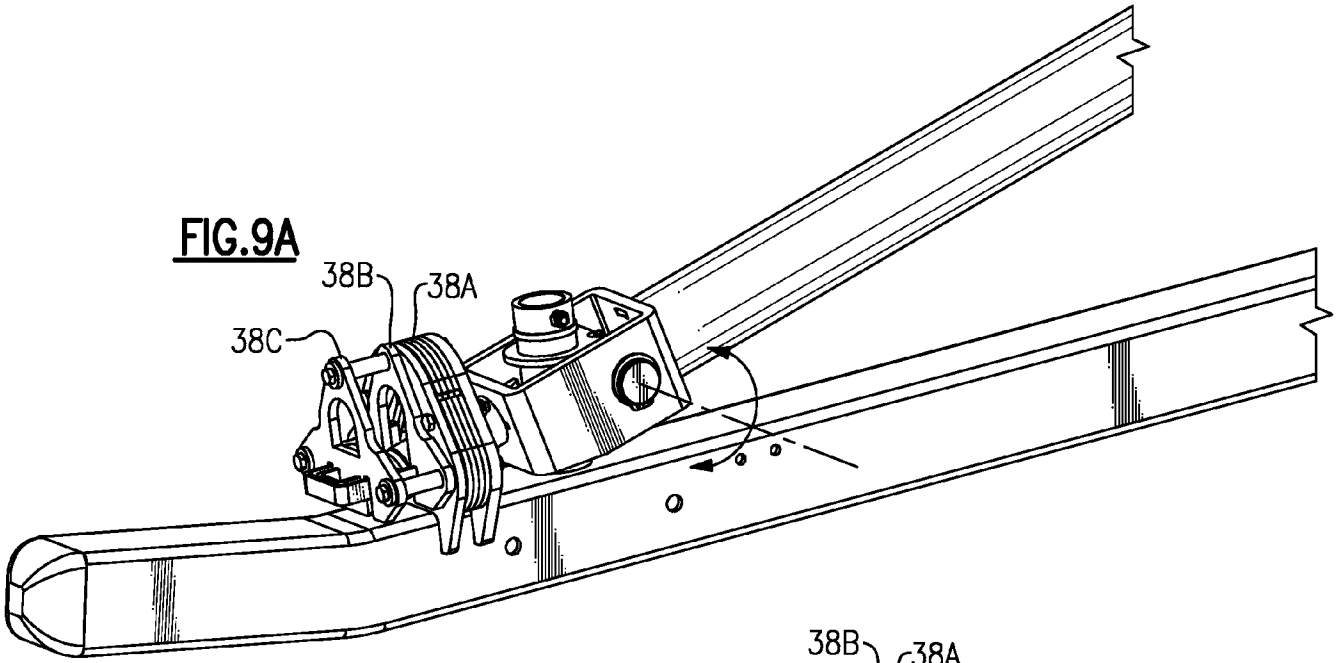
FIG. 9A is a perspective view of a cartridge system of the range of motion assembly of the football blocking sled, the cartridge system having a second cartridge plate positioned to provides a vertical range of motion of the arm relative to the sled frame.
Figure 9B:
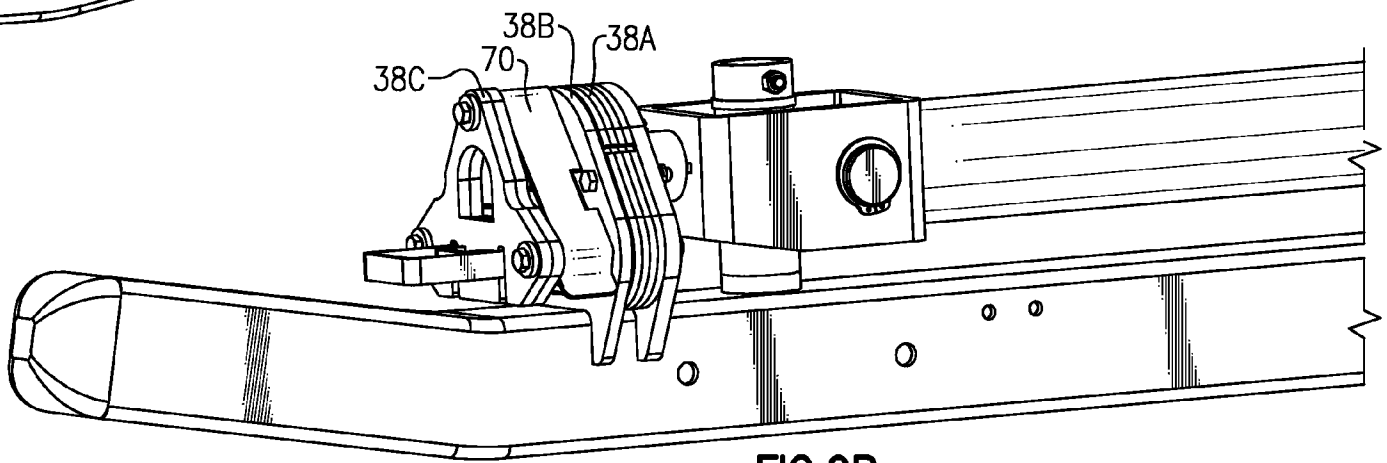
FIG. 9B is a perspective view of a cartridge system in the FIG. 9A position with a lock plate installed.

The cartridge plate 38B includes a generally rectilinear aperture 58B. The shape of the aperture 58B restricts movement of the arm 14 to permit, for example, only vertical movement relative to the sled frame 12. That is, when the cartridge plate 38B is slid along the standoffs 62 to be directly adjacent cartridge plate 38A the generally rectilinear aperture 58B is engaged with the cam 54 to supersede the constraint otherwise provided by aperture 58A (FIG. 9A). The removable lock 70 may be snapped onto the standoffs 62 between the cartridge plate 38B and cartridge plate 38C to axially retain the cartridge plate 38B and assure that generally rectilinear aperture 58B is engaged with the cam 54 (FIG. 9B).

Figure 10A:
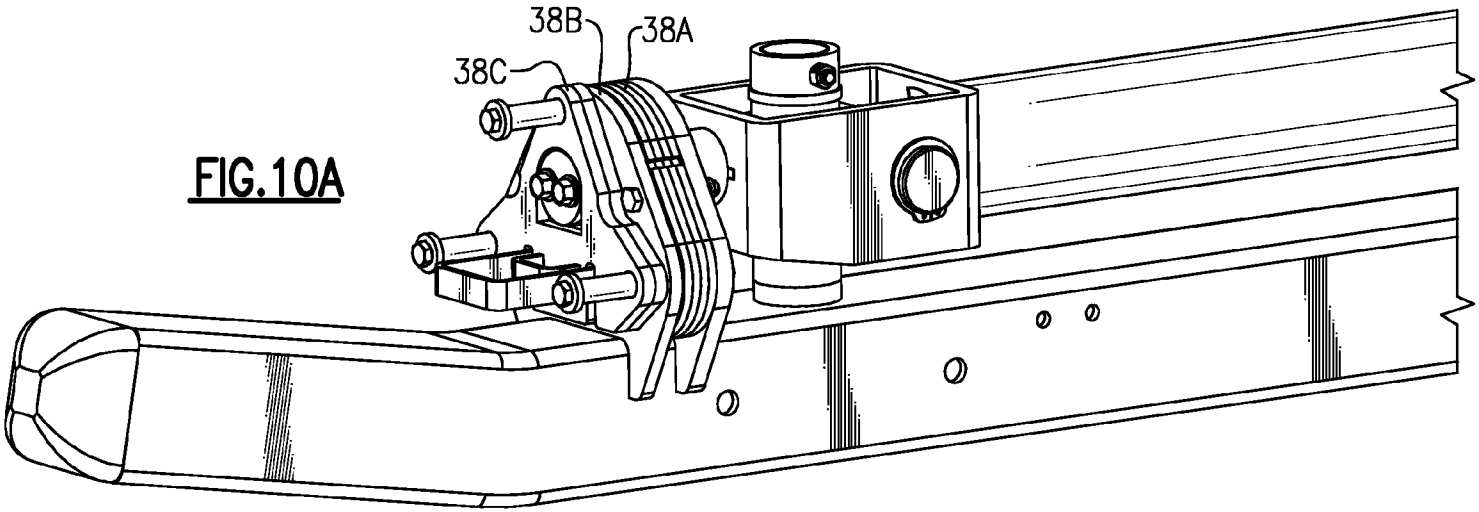
FIG. 10A is a perspective view of a cartridge system of the range of motion assembly of the football blocking sled, the cartridge system having a third cartridge plate positioned to lock the arm relative to the sled frame.
Figure 10B:
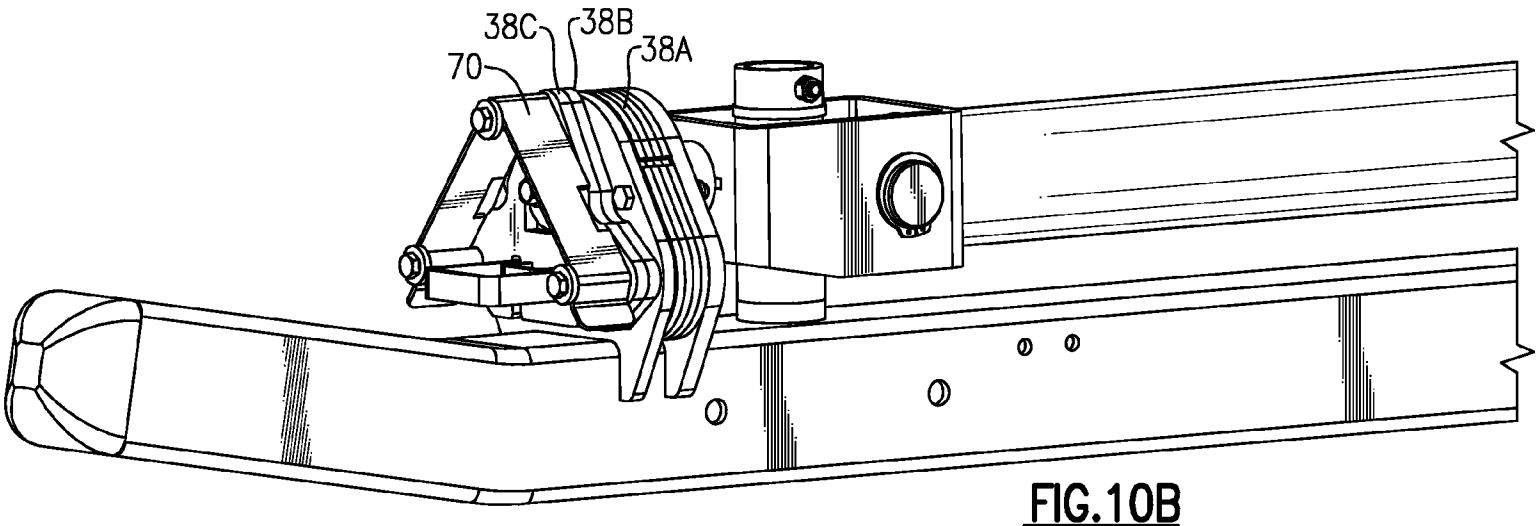
FIG. 10B is a perspective view of a cartridge system in the FIG. 10A position with a lock plate installed.

The cartridge plate 38C includes an aperture 58C which is sized to be generally equivalent to the shape of the cam 54. The shape of the aperture 58C thereby locks the arm 14 in a fixed position relative to the sled frame 12 when the cartridge plate 38C is slid adjacent to the cartridge plate 38B (FIG. 10A). That is, the more limited aperture 58C engages the cam 54 and supersedes aperture 38B. The removable lock 70 may then be snapped onto the standoffs 62 between the cartridge plate 38C and flanged ends of the stand off 62 to axially retain the cartridge plate 38C and assure that aperture 58C is engaged with the cam 54 (FIG. 10B).

It should be understood that alternative or additional cartridge plates with various other aperture shapes may be provided to further define a desired range of motion for arm 14. That is, the shape of the aperture 58 controls the envelope of motion of arm 14 relative to sled frame 12 to provide, for example movement to but one lateral side relative to the sled frame 12.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A blocking sled comprising:

a sled frame;

a pivot assembly mounted to said sled frame;

an arm movable relative to said sled frame through a range of motion defined by said pivot assembly; and a cartridge system with a multiple of cartridge plates, a first of said multiple of cartridge plates fixed to said sled frame relative to said pivot assembly to restrict said range of motion.

2. The blocking sled as recited in claim 1, wherein said first of said multiple of cartridge plates defines an aperture.

3. The blocking sled as recited in claim 2, wherein said aperture is a generally triangular aperture.

4. The blocking sled as recited in claim 2, wherein said pivot assembly includes a cam which extends generally along an axis defined by said arm, said cam extends at least partially within said aperture.

5. The blocking sled as recited in claim 1, further comprising a blocking pad that is pivotably mounted to said arm and is pivotable relative to said arm through an arc defined about a pad axis.

6. The blocking sled as recited in claim 5, further comprising a damper assembly between said blocking pad and said arm.

7. The blocking sled as recited in claim 6, wherein said damper assembly is configured to damp pivoting movement of said blocking pad relative to said arm.

8. The blocking sled as recited in claim 5, wherein said pad axis is transverse to said arm.

9. The blocking sled as recited in claim 5, wherein said blocking pad arc is movable between a forwardly canted position and a rearwardly canted position relative to said arm.

10. The blocking sled as recited in claim 1, wherein said cartridge system includes a second of said multiple of cartridge plates, said second of said multiple of cartridge plates movable between a first position spaced away from said first of said multiple of cartridge plates and a second position adjacent to said first of said multiple of cartridge plates and fixed to said sled frame, said second of said multiple of cartridge plates operable to restrict said range of motion when said second of said multiple of cartridge plates is in said second position.

11. The blocking sled as recited in claim 10, wherein said cartridge system includes a third of said multiple of cartridge plates, said third of said multiple of cartridge plates movable between a first position spaced away from said second of said multiple of cartridge plates and a second position adjacent to said second of said multiple of cartridge plates in said second position and fixed to said sled frame, said third of said multiple of cartridge plates operable to essentially eliminate said range of motion when said third of said multiple of cartridge plates is in said second position.

12. The blocking sled as recited in claim 10, wherein said cartridge system includes a second of said multiple of cartridge plates, said second of said multiple of cartridge plates movable between a first position spaced away from said first of said multiple of cartridge plates and a second position adjacent to said first of said multiple of cartridge plates and fixed to said sled frame, said second of said multiple of cartridge plates operable to eliminate said range of motion when said second of said multiple of cartridge plates is in said second position.

13. The blocking sled as recited in claim 1, wherein said range of motion extends along a curved path.

14. The blocking sled as recited in claim 1, wherein said first of said multiple of cartridge plates is configured to restrict a pivoting motion of said arm relative to said sled frame.

15. A blocking sled comprising:

a sled frame;

an arm;

a pivot assembly that pivotably couples said arm to said sled frame such that said arm is configured to pivot relative to said sled frame; and a cartridge system having at least one cartridge plate that restricts a pivoting movement of said arm.

16. The blocking sled of claim 15, wherein said at least one cartridge plate provides an aperture that receives a cam of said arm.

17. The blocking sled of claim 15, wherein said pivot assembly pivotably couples said arm to said sled frame such that said arm is configured to pivot relative to said sled frame both vertically and horizontally.

18. The blocking sled of claim 15, including a first and a second cartridge plate of said at least one cartridge plate, said first cartridge plate providing an aperture that permits a first range of pivoting motion of said arm and said second cartridge plate providing an aperture that permits a second range of motion of said arm.

19. The blocking sled of claim 15, including a first and a second cartridge plate of said at least one cartridge plate, said first cartridge plate providing an aperture that receives a cam associated with said arm to permit a range of pivoting motion of said arm that is greater than a range of pivoting motion permitted by an aperture of said second cartridge plate.

20. The blocking sled of claim 15, wherein said at least one cartridge plate provides an aperture that receives a cam of said arm, and said cam contacts said at least one cartridge plate to limit pivoting movement of said arm.

* * * * *